United States Patent [19]

Kelm et al.

[11] 4,359,208

[45] Nov. 16, 1982

[54] EMERGENCY BRAKE CONTROL FOR HOISTS

[75] Inventors: Alvin Kelm, Brookfield; Edward S. Freiwald, Pewaukee, both of Wis.

[73] Assignee: Rexnord Inc., Milwaukee, Wis.

[21] Appl. No.: 154,846

[22] Filed: May 30, 1980

[51] Int. Cl.[3] ..... B66D 1/48

[52] U.S. Cl. ..... 254/362; 303/92; 318/261

[58] Field of Search ..... 254/267, 270–274, 254/360–362; 187/39, 89; 303/92, 103; 104/178, 179, 183; 318/261, 372, 374

[56] References Cited

U.S. PATENT DOCUMENTS

| | | | |
|---|---|---|---|
| 2,823,897 | 2/1958 | Kellogg | 254/270 X |
| 3,497,787 | 2/1970 | Fuelster et al. | 254/267 X |
| 3,707,922 | 1/1973 | Dillon | 254/274 X |
| 3,934,856 | 1/1976 | Shaw | 254/267 |
| 4,087,078 | 5/1978 | Joraku et al. | 254/362 |

FOREIGN PATENT DOCUMENTS

| | | | |
|---|---|---|---|
| 676543 | 7/1979 | U.S.S.R. | 254/267 |

*Primary Examiner*—John M. Jillions

[57] ABSTRACT

An emergency brake control system for hoists including means for generating a first electrical signal indicating the direction of travel of a conveyance, means for generating a second signal indicating the presence or absence of an emergency situation and control means responsive to the first and second signals for immediately applying the emergency brake when the conveyance is descending and an emergency exists and delaying application of the emergency brake only after the conveyance has come to a complete stop when the conveyance is ascending and an emergency exists. Overriding safety features may also be employed to provide immediate application of the emergency brake regardless of the direction of travel of the conveyance of certain emergencies, such as over travel of the conveyance, exist.

10 Claims, 2 Drawing Figures

EMERGENCY BRAKE CONTROL FOR HOISTS

BACKGROUND OF THE INVENTION

The present invention relates to emergency brake control systems and more particularly to such systems used in hoists such as mine hoists employed to transport a conveyance between the ground and the surface level.

Generally, hoists of the type to which the invention pertains include a rotating drum driven by a motor, and a conveyance attached to the drum by means of a cable that wraps around the drum as it rotates in one direction to raise the conveyance and unwraps as the drum rotates in the other direction to lower the conveyance. Occasionally emergency situations, such as over-speed or over-travel of the conveyance, may arise which require stopping the hoist immediately. Emergency braking system are therefore included in the control systems of such hoists.

Existing emergency braking systems provide for immediate stopping of the rotating drum regardless of the speed or direction of travel of the conveyance. While these relatively simple and uncomplicated systems do stop the conveyance in emergency situations, they are undesirable in systems in which deceleration rates of the conveyance must not exceed a maximum rate. Problems with deceleration rates may arise, for example, in the hoisting or ascending mode where the effect of gravity and emergency braking occurring simultaneously may exceed maximum allowable deceleration rates.

For example, instantaneous braking of the conveyance during ascent would stop the conveyance but the upward inertia of the equipment in the conveyance could cause it to rise off the conveyance floor; then it would crash back to the floor, causing possible damage to the equipment and the conveyance.

Existing braking control systems that have proved to do an adequate job of stopping the conveyance in emergency situations within allowable deceleration limits have included relatively complex and expensive electronic circuitry to slow down and bring the conveyance to a stop according to a predetermined program of deceleration rate. This circuitry is responsive to the speed of the conveyance and causes adjustments in the speed of the drum to be made to maintain the deceleration rate of the conveyance within prescribed limits. While the use of such complex electronic circuitry can be justified in some hoists, they are often too expensive for practical use in many hoisting applications, must occasionally be calibrated and adjusted, and are subject to human error or tampering.

SUMMARY OF THE INVENTION

The present invention overcomes the drawbacks associated with the relatively complex and expensive electronic emergency braking control systems by providing a control circuit designed to take advantage of gravity in bringing the conveyance to a complete stop after an emergency situation arises before the emergency brake is applied in the hoisting mode of operation.

The control circuit of the present invention comprises a means for generating a first electrical signal indicative of the direction of travel of said conveyance which may, as in the embodiment shown, include a generator mechanically coupled to the rotating drum of the hoist. The generator has an output signal of one polarity when the drum rotates in one direction, and has an output signal of the opposite polarity when the drum rotates in the opposite direction.

There is also provided a means for generating a second electrical signal indicative of the presence or absence of an emergency situation. The second signal may be generated by one or more switches that are operated to indicate an emergency situation thereby enabling application of the emergency brake.

A control circuit means responsive to said first and second signals is connected to immediately apply the brake when said first signal is indicative of descending motion or lowering of the conveyance and said second signal indicates the presence of an emergency situation but allows application of said brake only after said conveyance has come to a complete stop when said first signal indicates ascending motion or raising of the conveyance and said second signal indicates the presence of an emergency situation.

The control circuit may also be provided with additional safety features to provide immediate application of the emergency brake regardless of the direction of travel of the conveyance to allow adequate and timely braking in the event certain emergencies exist which warrant deceleration of the conveyance at a rate outside the prescribed maximum.

The present invention will be more fully understood by reading the following description of the preferred embodiment with reference to the accompanying drawings in which:

FIG. 1 is a schematic circuit diagram of one embodiment of the control system constructed according to the principle of the present invention, and FIG. 2 is a schematic circuit diagram of another embodiment of the control system of the present invention which incorporates certain safety features.

DETAILED DESCRIPTION OF THE PREFERRED EMBODIMENT

Figure 1:
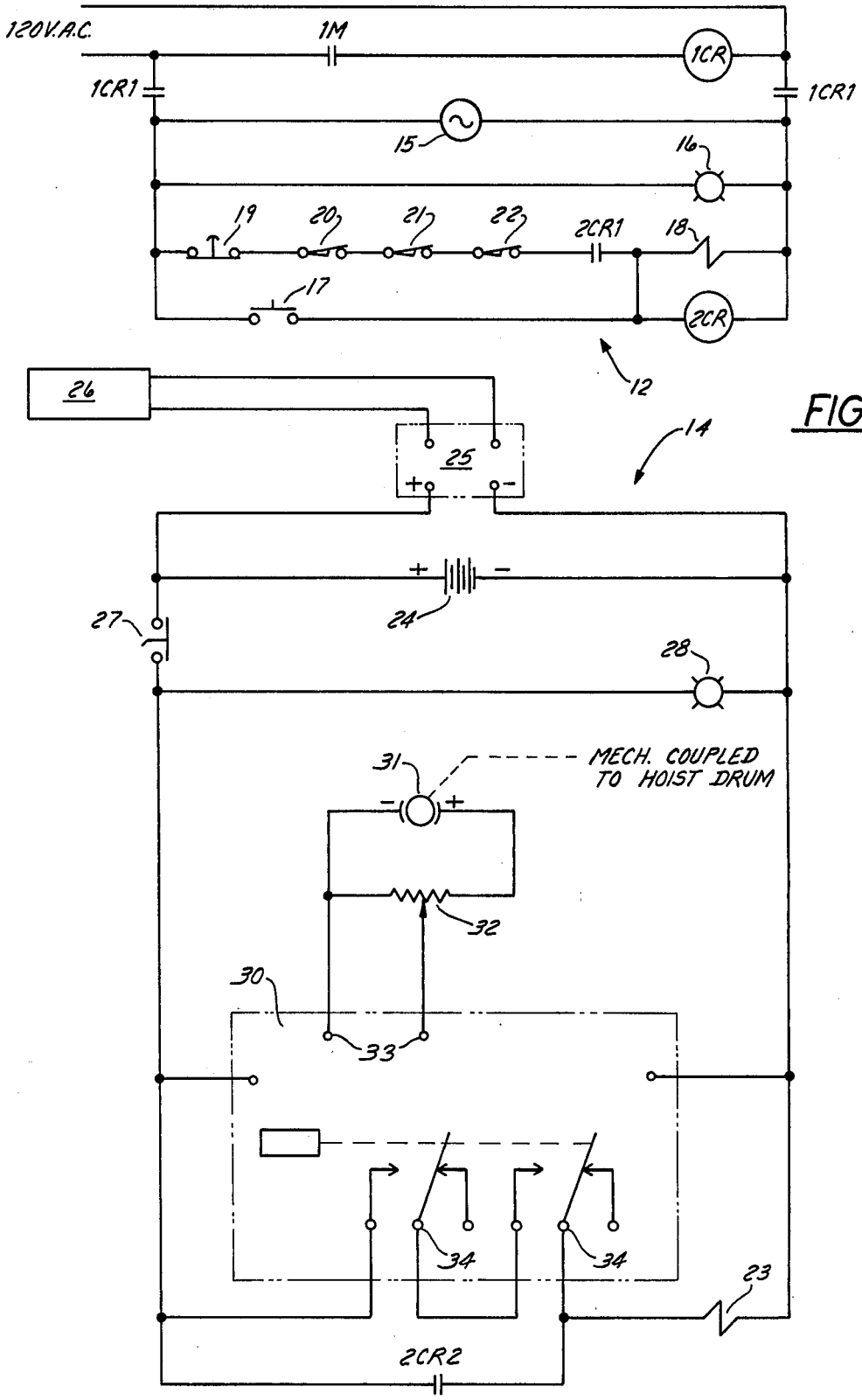

Referring now to FIG. 1, a control circuit constructed according to the principles of the present invention is shown as including what will be referred to for convenience as the motor control circuit 12 and the emergency brake control circuit 14.

In the embodiment shown, a motor (not shown) which drives hydraulic pump (not shown) has a magnetic starter and auxiliary contacts 1M. The hydraulic fluid from the pump is employed to rotate the hoist drum (not shown). When power is applied to a starter, contact 1M closes applying power to first control relay 1CR to close the contacts 1CR1 and connect the remainder of the motor control circuit 12 to line voltage. If desired, a heat exchange fan motor 15 may be used. A light 16 is provided to visually indicate the presence of AC power to the control circuit. When the operator desires to commence the hoisting operation, the brake release and reset button 17 is pushed to simultaneously energize a second control relay 2CR and a first solenoid 18 that controls the flow of hydraulic fluid to the motor. The second control relay 2CR closes contacts 2CR1 to connect a series of emergency switches 19, 20, 21 and 22 to the motor control circuit 12, and also closes contact 2CR2 in the emergency brake control circuit 14 to energize a second solenoid 23 that releases the emergency brake (not shown).

The brake control circuit 14 is operated from a low voltage twelve volt DC battery 24 that is preferably connected in parallel to a floating battery charger 25 powered by an uninterruptable AC power source 26 such as a lighting circuit. A DC switch 27 may be provided to connect and disconnect the brake control circuit from the DC battery 24. A light 28 is connected to indicate the presence of DC power to the brake control circuit 14.

A voltage polarity sensitive relay 30, such as an AP1000 manufactured by Action Instruments of San Diego, Calif., is connected in parallel with the battery 24 and has input terminals 33 connected to the output of a DC tach generator 31, such as that manufactured by Zero-Max of Minneapolis, Minn. The generator 31 is mechanically coupled to the hoist drum and rotates with it, so that the polarity of the generator output is indicative of the direction of rotation of the hoist drum. The polarity shown is indicative of descending travel or lowering of the conveyance. Variable resistor 32 is provided to adjust the magnitude of the output voltage of the generator to correspond with the input voltages acceptable to the particular voltage polarity relay 30 used. In the case of the AP1000 relay, a maximum input of ±10VDC is acceptable.

The voltage polarity sensitive relay 30 includes a set of Form C contacts 34, shown in their normally open position. This relay 30 is energized when the input voltage polarity at the input terminals 33 is indicative of ascending motion or raising of the conveyance so that the contacts 34 are closed when the conveyance is being raised.

In operation, when one of the emergency switches 19, 20, 21, 22 is opened by the occurrence of a condition while the conveyance is being lowered which requires emergency braking of the hoist convenyance. The opening of the emergency switches 19, 20, 21, or 22 in the motor control circuit 12 deenergizes the second control relay 2CR thereby opening contacts 2CR2 in the brake control circuit 14 to deenergize the emergency brake solenoid 23 to immediately apply the emergency brake. Because the conveyance is descending at the time the emergency signal is given, the tach generator 31 provides a voltage of the polarity shown in FIG. 1 which does not energize the voltage polarity sensitive relay 30, thereby allowing contact 2CR2 in the brake control circuit 14 to deenergize the emergency brake solenoid 23. When control relay 2CR is deenergized, the first solenoid 18 is also deenergize causing the hydraulic fluid to bypass the motor to allow rotation of the drum to be stopped by application of the emergency brake.

If an emergency situation arises while the conveyance is being raised, the open emergency switch 19, 20, 21 or, 22 deenergizes the control relay 2CR which causes its contacts 2CR1, 2CR2 to open as before; however, since the conveyance is ascending, the generator 31 produces a voltage having a polarity opposite that shown in FIG. 1 which energizes the voltage polarity sensitive relay 30 to close contacts 34. The connection through contacts 34 maintains the emergency brake solenoid 23 in an energized state so that the emergency brake is not immediately applied even though contact 2CR2 is open.

During the time interval in which the hydraulic motor is disconnected by deenergizing the solenoid 18 by opening contact 2CR1 in the motor control circuit 12, the force of gravity on the conveyance eventually brings it to a stop. Once the conveyance is stopped and the drum therefore stops rotating, the voltage generated by tach generator 31 reduces to zero to deenergize relay 30. Contacts 34 then return to their normal position to deenergize brake solenoid 23 and apply the brake.

The foregoing embodiment provides immediate application of the emergency brake if the conveyance is descending or being lowered and delayed application of the emergency brake if the conveyance is being raised. The delay allows gravity to bring the conveyance to a stop. When the mechanical components of the conveyance are properly dimensioned and designed, the rate of deceleration is normally within the acceptable maximum deceleration rates allowed in most hoisting applications. It is therefore essential that an analysis of the deceleration of the conveyance under coasting conditions when ascending be made and the mechanical components be adjusted before utilizing the control system of the present invention.

While the control circuit of the embodiment shown in FIG. 1 provides for selective application of the emergency brake in a hoist, it is sometime desirable and often preferable to provide for immediate application of the emergency brake regardless of the direction of travel of the conveyance. For example, it would be desirable to immediately apply the emergency brake even though conveyance is ascending if delayed application of the brake would allow the conveyance to over travel its present limits.

Figure 2:
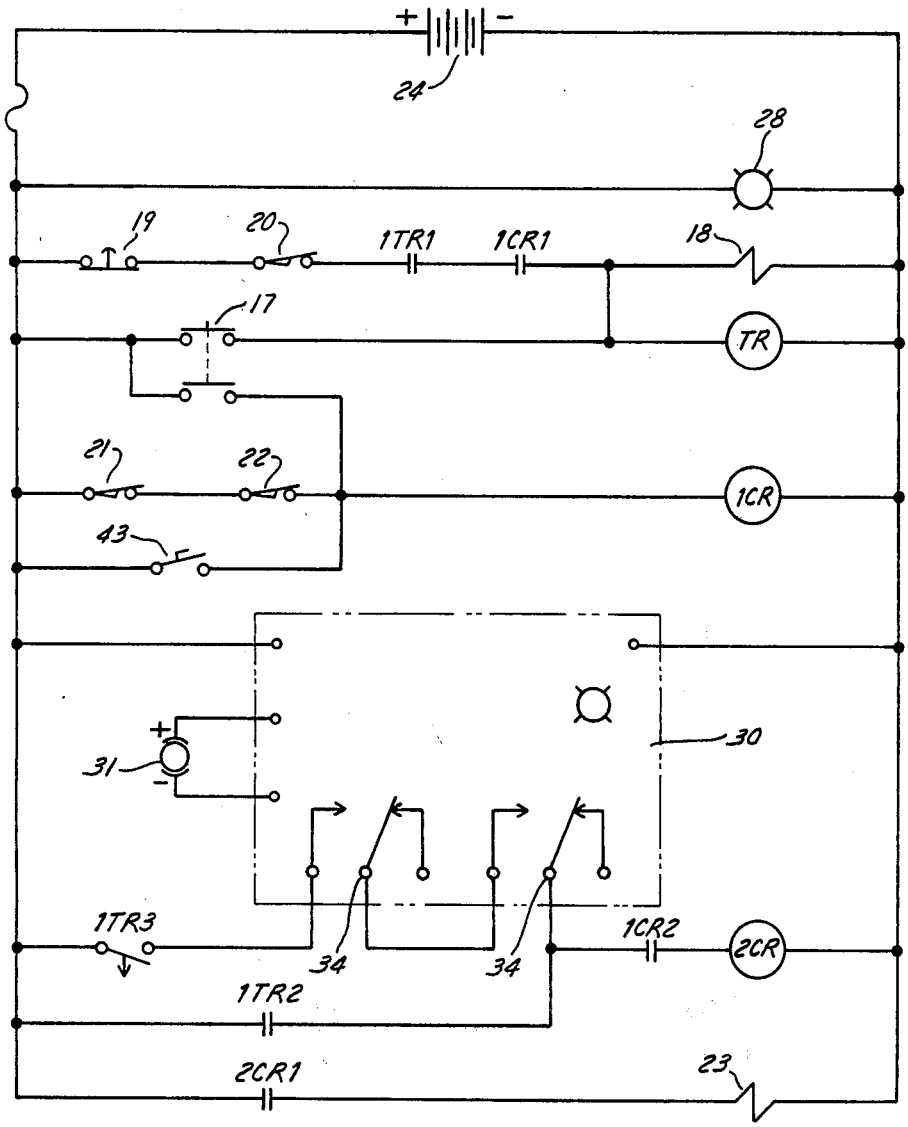

The embodiment of the present invention shown in FIG. 2 provides for such contingency. Moreover, the hydraulic fluid bypass solenoid 18 and the control relays 1CR, 2CR are connected in the battery powered 12 VDC control circuit 14 to allow control of the hoist in the event of a power failure. The embodiment of FIG. 2 which may, for example, employ for power a diesel motor, differs from that of FIG. 1 in that a timing relay TR is added to the brake control circuit 14 and the switches indicating over speed 20 and over travel 21, 22 of the conveyance are connected in series/parallel, not serially connected as in FIG. 1. The manual emergency stop button 19, the over speed limit switch 20, the instantaneous set of contacts 1TR1 of timing relay TR, and the normally open contacts 1CR1 of control relay 1CR are serially connected to the hydraulic bypass solenoid 18 that is in parallel with the timing relay TR. The over travel limit switches 21, 22 are serially connected to control relay 1CR. Footswitch 43 is also provided to bypass the over travel limit switches 21, 22 in the event hoisting or lowering must be commenced while the conveyance is in an over travel position. A practical reason for utilizing a footswitch 43 is that for total operation of an "overtravel backout" condition would otherwise require the use of three hands for each of the regular brake handle, the control to the hydraulic motor for motion, and the contact with reset button 19. Footswitch 43 replaces pushbutton 19 for this condition. An "overtravel backout" condition refers to a situation in which the conveyance has overtraveled at the top or bottom, and the operator necessarily must move the conveyance in the reverse direction.

When the manually operated emergency button 19 or the over speed limit switch 20 is opended while the conveyance is descending, the timing relay TR is deenergized to open instantaneous contacts 1TR 1, 2 thereby deenergizing the hydraulic fluid bypass solenoid 18 and control relay 2CR. Contacts 2CR1 immediately open to deenergize the emergency brake solenoid 23 and apply the emergency brake. Since the conveyance was descending, the generator 31 produced a voltage having a polarity that did not energize the relay 30, therefore its contacts 34 remained open to control relay 2CR.

If the bottom over travel limit switch 22 was opened while the conveyance was descending, control relay 1CR becomes deenergized thereby deenergizing control relay 2CR through contacts 1CR2 to deenergize the emergency brake solenoid 23 to immediately apply the brake. Again the polarity of the voltage produced by the generator 31 does not energize the relay 30.

When the conveyance is ascending and either the manually operated emergency button 19 or the over speed limit switch 20 is opened timing relay TR deenergizes thereby opening instantaneous contacts 1TR1 to deenergize the hydraulic fluid bypass solenoid 18. Since the conveyance is ascending, the polarity of the voltage of generator 31 has energized relay 30 to close its contacts 34. Control relay 2CR therefore remains energized until the force of gravity brings the conveyance to a stop thereby reversing the polarity of the generator 31 voltage to deenergize the relay 30 which in turn causes relay 2CR to deenergize and apply the emergency brake by deenergizing emergency brake solenoid 23. It will be noted that timed contacts 1TR3 provide for delayed deenergizing of control relay 2CR in the event the voltage polarity sensitive relay 30 does not function properly. The timed contacts 1TR3 can be adjusted to provide a time interval that deenergizes control relay 2CR after the voltage polarity sensitive relay 30 should have deenergized.

In the embodiment shown, if the top over travel limit switch 21 is opened while the conveyance is ascending, the emergency brake is immediately applied. This is because many situations warrant immediate braking in this emergency even though by doing so the maximum deceleration rate could be surpassed. It can be seen that opening of the top over travel limit switch 21 causes immediate application of the emergency brake as was the case when the bottom over travel limit switch 22 was opened when the conveyance was descending.

While two particular embodiments of the present have been described, it will be understood that changes and modifications, such as employing hydraulic analogs of electrical components, may be made without departing from the scope of the present invention as defined by the following claims.

We claim:

1. In a hoisting system of the type including a rotating drum, a conveyance, a cable attaching the conveyance to the drum; said drum being driven by a motor with an emergency braking means for stopping the motor, an emergency brake control system responsive to the direction of motion of said conveyance, said braking means responsive to said brake control system comprising:

means for generating a first signal indicative of the direction of motion of said conveyance, including an electrical generator mechanically coupled to said rotating drum, said generator capable of generating signals of voltages having opposite polarities, one polarity indicating ascending motion and the opposite polarity indicating descending motion of said conveyance;

means for generating a second signal indicative of the presence or absence of an emergency situation, including electrical switching means that open in the presence of an emergency situation and close in the absence of an emergency situation; and control circuit means responsive to the first and second signals when each are respectively indicative of descending motion and an emergency situation for immediately actuating said braking means, said control circuit means additionally responsive to the first and second signals when each are respectively indicative of ascending motion and an emergency situation for actuating said braking means after the conveyance has stopped its ascending motion, said second control circuit including a relay responsive to the polarity of said first signal, said relay connected to cause immediate application of said brakes when the polarity of said first signal is indicative of descending motion of said conveyance and cause application of said brake only after said conveyance has come to a complete stop when the polarity of said first signal is indicative of ascending motion of said conveyance.

2. An emergency brake control system as defined in claim 1 wherein said switching means comprises a plurality of switches responsive to excessive speed, excessive travel and manual operation of the emergency brake.

3. An emergency brake control system as defined in claim 2 further comprising a safety relay connected to immediately apply said brake regardless of the direction of motion of said conveyance if any of said switches responsive to excessive travel are open.

4. A method of controlling the operation of an emergency brake and a drive means for a hoist conveyance, comprising:

generating a first signal indicative of ascent or descent of said conveyance;

generating a second signal indicative of the presence or absence of an emergency condition, including any of over-speed, over-travel, or manual emergency stop, requiring the emergency stopping of the conveyance;

when said first signal indicates descent and said second signal indicates the occurrence of said emergency condition, applying said brakes immediately; and when said first signal indicates ascent and said second signal indicates over-speed or manual emergency stop signal, deenergizing said conveyance drive means and allowing said conveyance to coast to a stop, thereupon applying said brake.

5. The method defined in claim 4, further comprising the step of:

when said first signal indicates ascent and said second signal indicates over-travel, deenergizing said conveyance drive means and immediately applying said brake without waiting for said conveyance to coast to a stop.

6. A control system for a hoist having a conveyance, a brake for stopping said conveyance, and a drive means for selectively moving said conveyance upwardly and downwardly, said control system being operative to control the operation of said brake and said drive means in response to the direction of motion of said conveyance and the existence of an emergency situation, comprising:

first means for indicating the direction of motion of said conveyance;

second means for indicating the presence of an emergency situation;

control means for immediately actuating said braking means responsive to the first means when it indicates descent of conveyance, and responsive to the second means when it simultaneously indicates the presence of an emergency situation;

said control means additionally deenergizing said conveyance drive means and permitting said conveyance to coast to a stop, and thereupon actuating said braking means responsive to said first means when it indicates ascent of said conveyance, and when said second means simultaneously indicates an emergency condition.

7. In a hoisting system of the type including a rotating drum, a conveyance, a cable attaching the conveyance to the drum, driving means for driving said drum, and an emergency braking means for stopping the motor; the improvement comprising an emergency brake control system for controlling said emergency braking means responsive to the direction of motion of said conveyance, including:

means for generating a first signal indicative of the direction of motion of said conveyance;

means for deenergizing said driving means and automatically generating a second signal in the event of an emergency situation; and control circuit means responsive to said first and second signals, when said signals are respectively indicative of descending motion and an emergency situation, for immediately actuating said braking means;

said control circuit means additionally being responsive to said first and second signals, when said signals are respectively indicative of ascending motion and an emergency situation, for actuating said braking means after said driving means has been deenergized and when said first signal generating means indicates that the ascending conveyance has coated to a halt.

8. An emergency brake control system as defined in claim 7 wherein said means for generating said first signal comprises an electrical generator mechanically coupled to said rotating drum; said generator being capable of generating signals of voltages having opposite polarities, one polarity indicating ascending motion of said conveyance, and the opposite polarity indicating descending motion of said conveyance.

9. An emergency brake control system as defined in claim 8 wherein said means for generating said second signal comprises electrical switching means that open in the presence of an emergency situation and are closed in the absence of an emergency situation.

10. An emergency brake control system as defined in claim 9 wherein said control circuit means comprises a relay that is responsive to the polarity of said first signal; said relay being connected to cause immediate application of said braking means when the polarity of said first signal is indicative of descending motion of said conveyance, and when the polarity of said first signal is indicative of ascending motion of said conveyance, to cause application of said brake only after said conveyance has come to a complete stop.

* * * * *